US011235320B2

(12) United States Patent
Azpiroz et al.

(10) Patent No.: US 11,235,320 B2
(45) Date of Patent: Feb. 1, 2022

(54) SELF-TUNING SYSTEM FOR MANIPULATING COMPLEX FLUIDS USING ELECTROKINECTICS

(71) Applicant: INTERNATIONAL BUSINESS MACHINES CORPORATION, Armonk, NY (US)

(72) Inventors: Jaione Tirapu Azpiroz, Rio de Janeiro (BR); Peter William Bryant, Rio de Janeiro (BR); Ronaldo Giro, Rio de Janeiro (BR); Rodrigo Neumann Barros Ferreira, Rio de Janeiro (BR); Ricardo Luis Ohta, Rio de Janeiro (BR)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 719 days.

(21) Appl. No.: 14/878,800

(22) Filed: Oct. 8, 2015

(65) Prior Publication Data

US 2017/0102016 A1 Apr. 13, 2017

(51) Int. Cl.
*B01L 3/00* (2006.01)

(52) U.S. Cl.
CPC ..... *B01L 3/5027* (2013.01)

(58) Field of Classification Search
CPC ... B01L 3/5027; G05B 7/02; G01N 27/44713; G01N 27/447
See application file for complete search history.

(56) References Cited

U.S. PATENT DOCUMENTS

| | | | | |
|---|---|---|---|---|
| 5,215,883 | A * | 6/1993 | Chu | G01N 27/447 204/452 |
| 8,257,571 | B1 | 9/2012 | Cummings et al. | |
| 8,662,860 | B2 | 3/2014 | Hsieh et al. | |
| 8,815,070 | B2 | 8/2014 | Wang et al. | |
| 8,968,542 | B2 | 3/2015 | Davalos et al. | |
| 2004/0115838 | A1* | 6/2004 | Quake | B01D 57/02 436/538 |
| 2005/0089993 | A1* | 4/2005 | Boccazzi | B01F 13/0059 435/286.2 |
| 2006/0078998 | A1* | 4/2006 | Puskas | G01N 21/6428 436/64 |
| 2007/0023292 | A1 | 2/2007 | Kim et al. | |

(Continued)

*Primary Examiner* — Bethany L Martin
(74) *Attorney, Agent, or Firm* — F. Chau & Associates, LLC

(57) ABSTRACT

A system for manipulating electric fields within a microscopic fluid channel includes a fluid channel with an inlet and an outlet to support fluid flow, at least one controllable electric field producer that applies a non-uniform and adjustable electric field to one or more regions of the fluid channel, one or more sensors that measure one or more parameters of a fluid flowing through the fluid channel, and a controller with hardware and software components that receives signals from the one or more sensors representative of values of the one or more parameters and, based on the parameter values, drives one or more actuators to adjust the electric field produced by the plurality of electric field producers. A complex fluid including at least two components flows through the fluid channel, where at least one of the at least two components comprises particles controllable by the non-uniform and adjustable electric field.

14 Claims, 5 Drawing Sheets

(56) References Cited

U.S. PATENT DOCUMENTS

| | | | | |
|---|---|---|---|---|
| 2007/0164211 | A1* | 7/2007 | Flechsig | G01N 27/3276 250/288 |
| 2007/0231458 | A1* | 10/2007 | Gale | B01J 19/0046 427/2.11 |
| 2010/0224493 | A1* | 9/2010 | Davalos | B03C 5/005 204/547 |
| 2011/0247934 | A1* | 10/2011 | Wang | B01L 3/502792 204/450 |
| 2013/0118904 | A1 | 5/2013 | Dickerson et al. | |
| 2014/0151232 | A1 | 6/2014 | Hadwen | |
| 2014/0329699 | A1 | 11/2014 | Esfandyarpour | |
| 2015/0027895 | A1* | 1/2015 | Becker | B01F 13/0076 204/643 |

* cited by examiner

SELF-TUNING SYSTEM FOR MANIPULATING COMPLEX FLUIDS USING ELECTROKINECTICS

BACKGROUND

1. Technical Field

Embodiments of the present disclosure are directed to the manipulation of complex fluids, or one of its constituents, flowing through microchannels via the optimization of electric field landscapes capable of applying electrokinetic forces.

2. Discussion of the Related Art

Because of their potential as miniaturized laboratory platforms capable of performing entire biological and chemical experiments on small, inexpensive chips, there has been a rapid increase in research and development of microfluidics-based devices used for Point of Care (PoC), Lab on a Chip (LoaC), and immunoassays applications. Microfluidic devices can enable touchless manipulation of single cells, microorganisms, droplets or particles through the exploitation of electro-hydrodynamic effects, also known as electrokinetics, only noticeable at micro-scales. In particular, one such effect is known as dielectrophoresis.

A dielectrophoretic (DEP) force arises from the polarization of otherwise electrically neutral particles/cells/droplets when suspended in a non-homogeneous electric field. The application of an electric field induces a polarization due to imbalanced distributions of bounded charges, and acts to attract or repel particles/cells/droplets to or from electric field maxima for a positive or negative dielectrophoresis force, depending on the polarizability of the particle/cell/droplet relative to the suspending medium. These forces depend not only on the geometrical configuration and excitation scheme of the electric field but also on the dielectric properties of the particle/cell/droplet and of its suspending medium, hence can be used for discrimination, trapping, separation, isolation, mixing, filtration, concentration, controlling chemical reaction rates and many other useful tasks.

Electronic devices that incorporate an array or matrix of electrodes have been commonly used to manipulate droplets in applications such as digital microfluidics or displays based on electrowetting on dielectric (EWOD) that exploit another electrokinetic effect known as electrowetting (EW). EW refers to the modulation of surface hydrophobicity or wettability with an applied voltage that results from the accumulation of charged ions at the interface between a liquid and a solid.

Occasionally, such electrode arrays have also been used for particle and droplet manipulation using dielectrophoresis alone or in combination with EW. Some such arrays use CMOS technology where each electrode of the array is individually addressable from below. For example, if electrodes are isolated from each other, the voltage range, the size and shape of each electrode in the array can be adjusted during fabrication, and the channel dimensions and flow speed can vary depending on the characteristics of the particles being manipulated. Other arrays use a bilayer of two orthogonally oriented electrode lines addressed by in-plane contacts where the entire line and entire column needs to be activated to address the corresponding electrode element. This makes the device simpler to manufacture but less flexible.

Numerical optimization techniques have been used successfully in a wide variety of engineering and scientific applications, providing optimum designs under given constraints and optimized behavior for various use-cases. Control theory techniques have also been used in a wide variety of applications, including feedback loops to drive system towards desired behavior, in real time during system operation. Given the increasing importance of microfluidics-based PoC and LoaC devices, the employment of proven methods of optimization and control theory to improve the behavior of such devices is natural and much desired.

Particle, droplet or cell manipulation through dielectrophoresis uses an electric field gradient, which can be created in several ways: (1) With an arrangement of planar metallic electrodes deposited onto the walls and bottom of the microfluidic channel, often in direct contact with the fluid containing the particles; (2) With highly focused laser beams, often requiring large optical equipment; or (3) With a 2D array of electrodes, as described above, inserted in the channel.

Solutions exist for two types of related situations. In one situation, particles flow with the fluid and the electric field gradient patterns, and the electrode and channel structures that generate the gradients remain crudely designed layouts, including simple shapes, such as straight interdigitated, tapered, castellated, spiral or slanted electrodes, and of dimensions often only manually adjusted through experimental trial and error to achieve the desired effects. Once an electrode design has been deposited on the device surface, it cannot be changed during device operation to accommodate possible variations on the particle composition and/or size, flow speed, temperature, pressure, fluid viscosity, salinity, etc. Such simple designs can be very sensitive to variability introduced during the manufacturing processes and can be prone to failure when this variability is significant.

As such, the electrode design is highly application specific and it can only serve the original design purpose, with no flexibility to perform multiple applications. Solutions based only on simulations are limited by the fidelity of models and by the knowledge of the boundary conditions and physical parameters, such as temperature, viscosity, flow speed, etc.

Another situation involves particles that are otherwise stationary. The known solutions use time-dependent field patterns that are controlled by an external routine to move the otherwise immobile particles by using points of stable equilibrium of the DEP force, often by building 2D arrays of independent electrodes on the bottom surface of the microchannel or microchamber.

Particle manipulation techniques using arrays of electrodes do not target the separation of particles in continuous flow in a fluid, but rather rely on traveling-wave dielectrophoresis (TWDEP) to manipulate the particles that are, otherwise, immobile. This involves dynamic patterns controlled by an external routine, instead of a static pattern that the particles pass through as they flow.

None of these solutions can prescribe a real-time optimization of field landscapes in an automated fashion. In the case of solutions based on the deposition of planar electrodes on the microchannel walls, the electrode design has to be determined at an early stage, for a specific set of particle sizes and materials, and then transferred permanently onto the device at the manufacturing stage. Such a device cannot be altered at a later time and will only be able to manipulate the very set of particles for which was designed.

Once an electrode design has been deposited on the device surface, it cannot be changed during device operation to accommodate possible variations on the particle composition and/or size, flow speed, temperature, pressure, fluid viscosity, salinity, etc. Moreover, such electrodes commonly have crudely designed layouts comprising simple shapes and of dimensions that are often only manually adjusted through trial and error to achieve the desired effects. Such simple designs can be very sensitive to variability introduced during the manufacturing processes and can be prone to failure when this variability is significant.

Solutions based on the deposition of a 2D array of electrodes do not combine the effects of the electric field and a flowing fluid on the particle movement and are limited to slow, incremental movements by switching on and off adjacent electrodes one by one. The result is slowly moving particles transported between two points of stable equilibrium by the effect of only the electric field, moving step by step or pixel by pixel, often a single particle at a time. This movement can be easily monitored manually by a user or observer with a microscope, who can also manually actuate the electrode pixels one at a time or delineate the desired path for the particle. This method can thus only handle a few particles that are nearly stationary, with very low throughput and is difficult to automate. Eventual washing steps can also be challenging to perform under this technique.

Solutions based on highly focused laser beams lack the portability, low-cost and ease-of-use that is desired for such devices. These devices use one or more laser beams, an intricate optical setup and much more power to run than do previous solutions. These solutions have not been built to be optimized for given operational parameters or to be tuned and controlled in real time.

However, none of the current solutions prescribes a dynamic or real-time optimization or control method for the electric field landscapes used to manipulate particles flowing in fluid in an automated fashion. Separation, concentration and/or trapping of specific particles flowing in a fluid, such as blood serum, saline buffer, microbeads for imunoassays, etc., in large quantities with little or no user intervention with high efficiency, accuracy and flexibility to accommodate variations on the material and device properties, such as material, geometric, or environmental properties, or that can accommodate or switch to an entirely different functionality, such as from a concentrator to a separator, is a desired functionality sought after in microfluidic devices.

SUMMARY

Exemplary embodiments of the disclosure as described herein generally include systems and methods for producing a dynamic electric field distribution within a fluid channel of microscopic dimensions, including nano-/millimeter dimensions, for the modulation of electro-hydrodynamic effects and, in consequence, the manipulation, including separation, trapping, steering, moving, etc., of particles, such as solid beads, liquid droplets, cells, etc., of different properties, such as size, chemical composition, morphology, surface functionalization, etc., flowing inside microchannels.

According to an embodiment of the disclosure, there is provided a system for manipulating electric fields within a microscopic fluid channel, including a fluid channel with at least one inlet and at least one outlet to support fluid flow, at least one controllable electric field producer that applies a non-uniform and adjustable electric field to one or more regions of the fluid channel, one or more sensors that measure one or more parameters of a fluid flowing through the fluid channel, and a controller with hardware and software components that receives signals from the one or more sensors representative of values of the one or more parameters and, based on the parameter values, drives one or more actuators to adjust the electric field produced by the plurality of electric field producers, where a complex fluid comprising at least two components flows through the fluid channel, where at least one of the at least two components comprises particles controllable by the non-uniform and adjustable electric field.

According to a further embodiment of the disclosure, the one or more actuators comprise one of an electric field actuator, a heater, and a mechanical mixer.

According to a further embodiment of the disclosure, the software component of the controller uses an optimization algorithm to control the one or more actuators via the hardware component to adjust the electric field to control flow of the complex fluid through the fluid channel according to a pre-determined criteria.

According to a further embodiment of the disclosure, the optimization algorithm is one of a genetic algorithm, a Monte Carlo algorithm, a particle swarm optimization algorithm, a conjugate gradient algorithm, a gradient descent algorithm, a Newton's method, a heuristic algorithm, a simulated annealing algorithm, a combinatorial optimization method, and a stochastic optimization method.

According to a further embodiment of the disclosure, the optimization algorithm optimizes output of an objective function, that is a function of one of differences between electrical, optical, or magnetic properties of the complex fluid, differences in particle flow rates or particle flow speeds at two or more locations in the fluid channel or at one location relative to a reference value, or differences in particle positions when crossing one or more locations in the fluid channel relative to a reference location.

According to a further embodiment of the disclosure, the hardware component of the controller controls the one or more actuators based on output of a feedback control loop of the software component to adjust the electric field to maintain the flow of the complex fluid through the fluid channel in a reference state.

According to a further embodiment of the disclosure, the parameters include one or more of a particle size, a chemical composition, a chemical reaction rate, a morphology, a surface functionalization, a particle mass, an impedance at a single frequency, an impedance within a frequency range, a temperature, a viscosity, a flow speed, and an image pattern.

According to a further embodiment of the disclosure, the software component of the controller calculates transfer functions based on sensor signals that describe system responses to input from the actuators.

According to a further embodiment of the disclosure, the electric field producers include one or more of a pair of parallel electrically conductive plates, a 2-dimensional array of individually controllable electrodes, and an electromagnetic energy source with a diffractive optical element.

According to a further embodiment of the disclosure, the electric field is adjusted to separate different types of particles within the complex fluid.

According to another embodiment of the disclosure, there is provided a system for manipulating electric fields within a microscopic fluid channel, including a fluid channel with at least one inlet and at least one outlet to support fluid flow, a 2-dimensional (2D) array of individually controllable electrodes that apply a non-uniform and adjustable electric field to one or more regions of the fluid channel, an electric field actuator that drives the array of individually addressable electrodes, one or more sensors that measure one or more parameters of a fluid flowing through the fluid channel, and a controller with hardware and software components that receives signals from the one or more sensors representative of values of the one or more parameters and, based on the parameter values, drives the electric field actuator to adjust the electric field produced by the plurality of electric field producers, where a complex fluid comprising at least two components flows through the fluid channel, where at least one of the at least two components comprises particles controllable by the non-uniform and adjustable electric field, and the electric field is adjusted to manipulate different types of particles within the complex fluid.

According to a further embodiment of the disclosure, the system includes a plurality of actuators controllable by the controller to affect physical properties of the complex fluid, where the actuators include a heater and a mechanical mixer.

According to a further embodiment of the disclosure, the software component of the controller uses a result of an optimization algorithm to drive the electric field actuator to adjust the electric field to manipulate the flow of the complex fluid through the fluid channel according to a predetermined criteria, where the optimization algorithm optimizes a value of an objective function that relates a configuration of the 2D array of individually controllable electrodes and other actuators to values of the one or more parameters measured by the one or more sensors.

According to a further embodiment of the disclosure, the software component of the controller uses a feedback control loop to control the electric field actuator to adjust the electric field to maintain the flow of the complex fluid through the fluid channel in a reference state, based on values of the one or more parameters measured by the one or more sensors.

According to a further embodiment of the disclosure, the parameters include one or more of a particle size, a chemical composition, a chemical reaction rate, a morphology, a surface functionalization, a particle mass, an impedance at a single frequency, an impedance within a frequency range, a temperature, a viscosity, a flow speed, and an image pattern.

According to another embodiment of the disclosure, there is provided a non-transitory program storage device readable by a computer, tangibly embodying a program of instructions executed by the computer to perform the method steps for optimizing an electrical field distribution in a microfluidics-based device, the method including receiving values of one or more operation parameters of a complex fluid flowing in a microchannel, the values measured by one or more sensors in the microchannel, the complex fluid including at least two components, where at least one of the at least two components comprises particles controllable by an electric field, adjusting electric field generation parameters to control an electric field in the complex fluid based on the received operation parameter values, and repeating the steps of receiving values of one or more operation parameters and adjusting electric field generation parameters until a predetermined flow pattern is achieved.

According to a further embodiment of the disclosure, the method includes using electric field generation parameters that correspond to operation parameters of an optimized value of an objective function to control electrode fabrication on a substrate of a microchannel in a microfluidics device.

According to a further embodiment of the disclosure, repeating the steps of receiving values of one or more operation parameters and adjusting electric field generation parameters until a predetermined flow pattern is achieved comprises optimizing a value of an objective function of the operation parameters according to a predetermined criteria.

According to a further embodiment of the disclosure, repeating the steps of receiving values of one or more operation parameters and adjusting electric field generation parameters until a predetermined flow pattern is achieved comprises using a feedback loop to determine a response of the complex fluid flowing in the microchannel to changes in the electric field generation parameters.

According to a further embodiment of the disclosure, the electric field is generated by an interference pattern of several optical wavefronts illuminating the microchannel at various incident angles with a pre-defined amplitude and phase, through the use of a 2D diffractive optical element, and further comprising saving parameters for generating a plurality of interference patterns to deploy a microfluidics device with a plurality of operational states.

According to a further embodiment of the disclosure, the method includes using machine learning techniques to classify sets of operation parameters based on a similarity measure, and using a set of classified operation parameters to initialize an electric field in another microfluidics-based device.

DETAILED DESCRIPTION OF EXEMPLARY EMBODIMENTS

Figure 1:
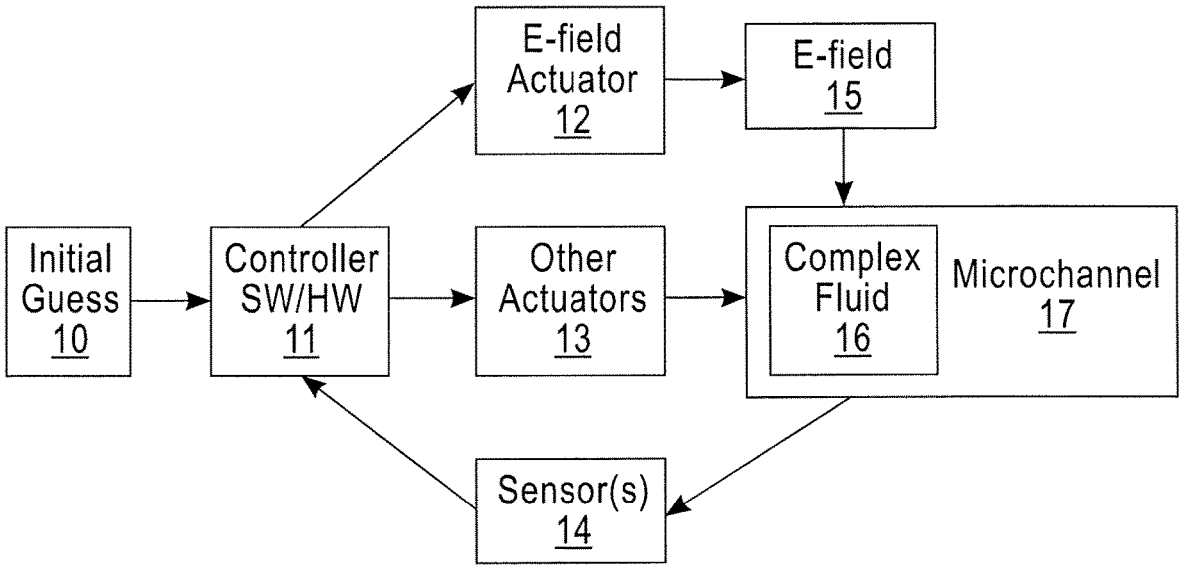
FIG. 1 depicts a block/flow diagram of a fluid manipulation process according to an embodiment of the disclosure.

Exemplary embodiments of the disclosure can provide a system for actively controlling or for optimizing in real time the electrical field landscape by using real data in an automated fashion. Embodiments of the disclosure can provide a method that allows for the automatic optimization of an electric field distribution based on data collected in real-time to manipulate particles/cells/droplets as they are carried by fluid flowing in a microchannel. Accordingly, while the disclosure is susceptible to various modifications and alternative forms, specific embodiments thereof are shown by way of example in the drawings and will herein be described in detail. It should be understood, however, that there is no intent to limit the disclosure to the particular forms disclosed, but on the contrary, the disclosure is to cover all modifications, equivalents, and alternatives falling within the spirit and scope of the disclosure.

A single device according to an embodiment of the disclosure can dynamically optimize itself for multiple functions, such as separation, concentration, trapping, mixing, emulsification, etc., whereas existing devices have fixed designs that are not necessarily optimized and that only target a single functionality. The automation of the design and optimization of electric field (hereinafter referred to as E-field) distribution as well as real-time adjustments can maximize performance and reduce uncertainty that is, for example, associated with detection or diagnosis, to control chemical reaction rates or optimize separation process for emulsions, etc. A system according to other embodiments of the disclosure can be made more robust against varying operating conditions by implementing a control loop to restore the system towards a reference output. Overall, embodiments of the disclosure apply E-field distributions that are designed and optimized based on real data in real time, which can more accurately represent a system than other design methods based on approximate mathematical models as used in prior art solutions. In addition, embodiments of the disclosure can enable rapid prototyping of new electric field landscapes and the electrode and channel structures that generate them for various flow or operation regimes, saving time for building new devices for each test.

A system according to an illustrative embodiment of the disclosure is depicted in FIG. 1 and includes (1) a passive part and (2) an active part. Referring now to the figure, a passive part according to an embodiment of the disclosure includes a complex fluid 16 flowing in a microchannel 17. The flow can be driven by any external force, such as forces generated by a micropipette, a pressure pump, a syringe pump, a capillary pump/pressure, gravity, etc. The complex fluid can be a binary mixture or an emulsion/colloid in which particles, such as solid beads, liquid droplets, cells, etc., with known properties, including size, chemical composition, morphology, surface functionalization, etc., are dispersed in the continuous fluid phase.

An active part according to an embodiment of the disclosure includes a controller unit 11 that includes both hardware and software, an E-field actuator 12 that drives the generation of the E-field 15, one or more sensor components 14 as well as other type of actuators 13 that operate directly on the microchannel and fluid. The controller unit 11 initializes operation of the E-field actuator 12 and other actuators 13 based on receipt of an initial best guess 10 of operational parameters of the microchannel 17. The E-field can apply direct or indirect forces on the particles or phases to manipulate them. The sensor component(s) measures and/or quantifies the outcome of the manipulation, represented by the values of properties of the fluid or the particles. The hardware element of the controller unit can include devices such as a circuit board with a microprocessor/microcontroller (hereinafter referred to as a CPU), signal generators and amplifiers to control the operation of the various actuators, as well as analyze the sensor readings. The software component can execute an optimization routine to determine the E-field distribution that best manipulates the above complex fluid based on the signals from the sensor or sensors. The optimization routine can be based on one or more well-known techniques such as genetic algorithms, or other less known or customized methods, to perform iterative optimization, self-tuning or active control of the E-field distribution by minimizing/maximizing the readings of the sensor. A control-loop can also be employed to adapt the system to further changes in the operation conditions, such as flow rate, temperature, etc.

According to embodiments of the disclosure, the determination of the E-field distribution can be formulated as an optimization task with a user-defined cost/objective function using a feedback mechanism based on real data, i.e., based on real measurements of certain properties in the microchannel. For example, the measurements can correspond to the position of a particle relative to a desired location in the microchannel, or the volume of certain types of particles passing through a specified location in the microchannel, or measurement of a certain fluid properties such as electrical impedance at a specified location in the microchannel. The determination of the E-field is an iterative process in which the E-field is changed after each iteration according to the output of an optimization routine until the output of the objective function converges to the desired value. The optimization routine is executed by the software component of the controller unit, using measurements from the sensors to compute the objective function output after each iteration and determine how the E-field should change to maximize/minimize the objective function. In addition to the optimization routine to determine the E-field distribution that best produces the desired objective function output, a control loop can be implemented to actively maintain the system operating at the desired state. This control loop uses measurements from sensors to monitor variations of the system parameters such as temperature, flow speed, etc, and drives adjustments to the electrode configuration or other actuators, such as heaters, a light emitter or mechanical mixer, in real time, to drive the state of the system toward a desired reference state.

According to embodiments of the disclosure, optimization methods include, but are not limited to, a genetic algorithm, a Monte Carlo algorithm, a particle swarm optimization algorithm, a conjugate gradient algorithm, a gradient descent algorithm, a Newton's method, a heuristic algorithm, a simulated annealing algorithm, a combinatorial optimization method, or a stochastic optimization method, which can be used to obtain the optimal E-field distribution in response to its effect on the flowing particles in real time and with real data. These algorithms can produce more advanced active electrode pixel configurations that are more effective, efficient, robust and flexible than manually tuned configurations because optimization algorithms can often search over a larger parameter space and can produce nonintuitive solutions.

According to embodiments of the disclosure, a feedback mechanism can be based on image sensors placed directly on top or bottom of the electrode array, or placed on locations that capture a certain area of interest in the microchannel, such as detection chambers away from the electrode array, and combined with image recognition/processing software to extract particle information. Sensor disposition and type can be determined by what is to be detected as well as the type of manipulation required. Sensors may include photodetectors for sensing fluorescent particles and sensors for impedance, transmittance, temperature, pH, chemical concentration of a certain compound, etc., depending on the nature of the particles and compounds to be detected. Practical implementations of such feedback mechanisms may include measurements of optical radiation intensity at a desired location, measurements of changes in capacitance, impedance or other physical properties at a desired location in the microchannel, and other environmental/device parameters such as temperature, fluid speed, viscosity, etc. Transfer functions can be calculated from sensor signals that describe the system's response to varying input from an E-field source, a heater, a light emitter, a mechanical mixer, etc.

An objective function, according to an embodiment of the disclosure, can involve maximizing the volume of a certain type of particle passing through a desired location in the channel, or the difference in volume at two separate locations, such as on each lateral side of the channel, to determine successful concentration or separation, or maximizing fluorescent radiation from particles accumulated at a desired location in the device, such as a chamber, to signal maximum concentration.

The E-field distribution, according to an embodiment of the disclosure, can be created and changed in real time using several mechanisms. One mechanism uses an optical setup to generate an optical wavefront through the interference of laser beams highly focused inside the microchannel, such as a wavefront generator comprised of an array of micromirrors with adjustable orientation or other means to produce an arbitrary hologram. The hologram can also be created by shining a laser through a liquid crystal display. By controlling the opacity of the display at each pixel location, an adaptative mask can be generated that projects a hologram into the microchannel when laser light passes. Another mechanism uses an array of electrodes on one or more of the channel surfaces where each electrode can be individually addressed and its voltage modulated. Other mechanisms can use a pixelated screen where each pixel or element can be individually addressed to change its transparency, such as a liquid crystal display, and exposing the screen with an unpatterned illumination. Other mechanisms that can generate strong and highly localized electric fields include surface plasmons or nanoantennas.

The state of the system, according to an embodiment of the disclosure, can be fully determined by the state of the electric field and the operational parameters, i.e., flow rate, temperature, viscosity, density, chemical composition, etc, and the positions of the particles. The state of the E-field, denoted M, can in some embodiments be described by a matrix that represents the voltage configuration of the electrode array or opacity patterns of the optical elements that generate a 2D electric field distribution. The operational parameters, denoted by {p}, represent the set of variables that can potentially alter the behavior of the system. The positions of the particles can be represented by $\vec{x}_i$, where the index i labels individual particles. The full state u of a system according to an embodiment of the disclosure can then be represented, symbolically, by $u=(M, \{p\}, \vec{x}_i)$.

Given a state u and a manipulation task, such as mixing, separating, trapping, etc., an objective function $f(u)=f(M, \{p\}, \vec{x}_i)$ according to an embodiment of the disclosure can be defined to measure how effectively the task is being performed. Since the value of f(u) cannot, in principle, be analytically calculated for the general case, according to embodiments of the disclosure, sensor readings can be used to estimate the value of the objective function experimentally. By changing u, the value of f(u) can be maximized/minimized, depending on the particular embodiment. An optimization routine according to an embodiment of the disclosure acts only on the M component of u, to optimize the electrical field distribution so that the objective function can attain its desired value.

If, during the execution, the operational parameters {p} change as a result of changes in the environment, u will change so that f(u) is no longer optimal. In this case, according to an embodiment of the disclosure, an additional control loop can be used to act on M, by changing the voltage/opacity patterns, and on {p}, by, for example, heating or cooling the fluid, to restore the optimality of f(u).

Exemplary embodiments of the disclosure include, inter alia, a microfluidic channel through which fluid flows, driven by, for example, an external pump or an integrated capillary pump, particles that can be labeled or otherwise individuated, that flow with the fluid, and that can be sensed at some point on the device, an electric field that interacts via DEP force to manipulate the particles as they flow, one or more sensors to detect the state of the system, software and hardware components that optimize, store, and update the electric field landscape to provide feedback to the optimization routine and control the state of the system.

Figure 2:
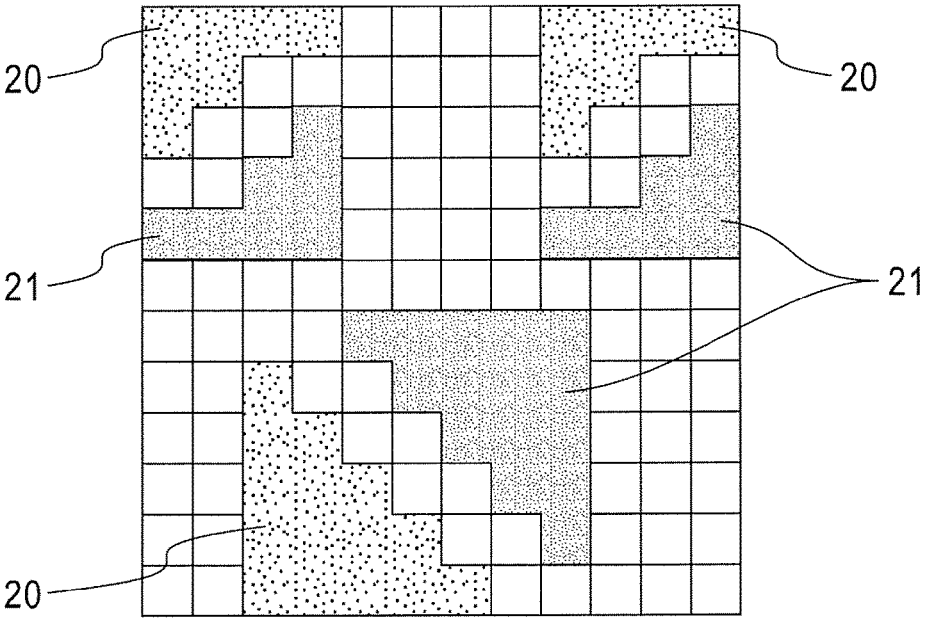
FIG. 2 shows an exemplary voltage pattern with positive (+) and negative (−) polarities on an electrode array according to an embodiment of the disclosure.

The electric field may be generated by, among other things, a 2D array of electrodes arranged in an P×Q matrix, that create voltage patterns as determined by the circuit board, where the voltage value at each electrode can be independently controlled (through P×Q controls) or controlled line/column-wise (through P+Q controls). FIG. 2 shows an exemplary voltage pattern with positive (+) 20 and negative (−) 21 polarities on an electrode array.

Figure 3:
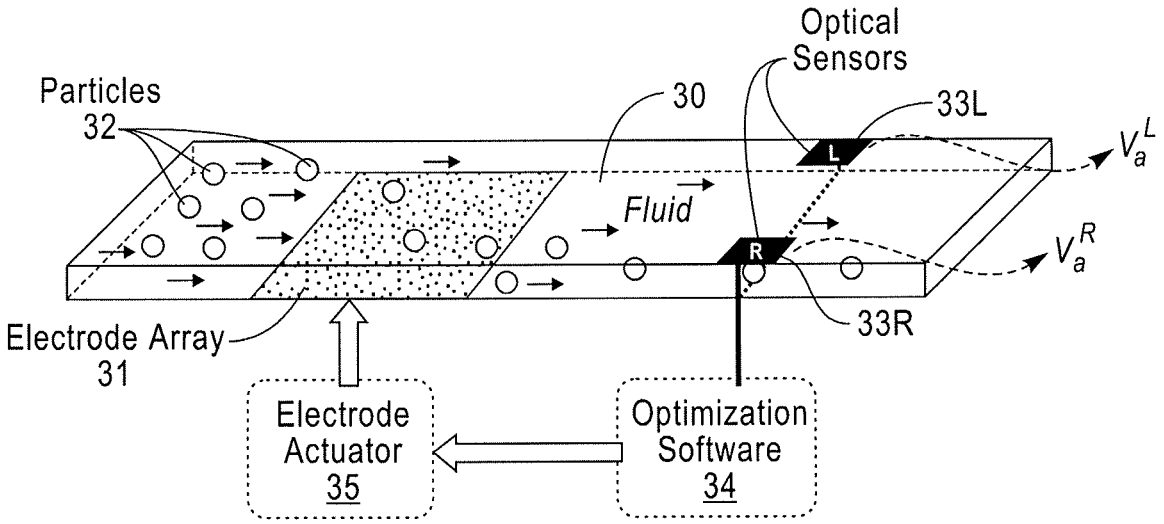
FIG. 3 displays a perspective view of a particle manipulation device comprising an array of electrodes embedded in a microchannel with a flowing fluid where particles are suspended, according to an embodiment of the disclosure.

FIG. 3 depicts a perspective view of the particle manipulation device according to one embodiment that includes a microchannel 30, an array of electrodes 31 embedded in the microchannel with individually addressable elements, particles 32 suspended in a fluid flowing along the channel, the particles initially distributed across the entire width of the channel 30. The array of electrodes 31 is excited with a configuration of voltages that generate DEP forces inside the microchannel 30 to guide particles 32 towards one side or the other for purposes of concentration and separation, for instance to separate rare cancer cells from blood serum to guide the cancer cells towards a side channel. The device further includes fluorescent/optical/electrical sensors 33R, 33L located at or beyond the exit of the array, with at least one on each side of the channel (L/R), that are used to detect the particles as they flow past that location. According to an embodiment, an objective function $f(u)=f(M,\{p\}, \vec{x}_i)=V_a^R-V_a^L$ is used to maximize the difference between the volume $V_a^R$ of particles a passing along a right side of the channel and the volume $V_a^L$ of particles a passing along the left side, although other functionality and cost functions can be envisioned. The output of the objective function can be optimized by changing the voltage configuration of the electrode array 31 to maximize particle concentration on the right side. An optimization software 34, based on measurement signals received from sensors 33R and 33L, provides an electrode actuator 35 the instructions required to readjust the voltages of the electrode array 31 so that f(u) is maximized.

An exemplary embodiment as illustrated in FIG. 3 includes an initialization and optimization phase, which apply iterative optimization algorithms to update a new electrode on/off 2D pattern in each iteration from the previous one and computes the resulting value of an objective function using measurements from the sensors. A process continues until convergence is achieved, i.e. when the value of the objective function has converged to within a predetermined range from an optimum value. The resulting electrode on/off pattern or configuration can be stored together with the experimental setup characteristics, such as particle and fluid properties, flow rate, temperature, and functionality, to allow the optimized pattern to be re-used in the future.

An exemplary embodiment as illustrated in FIG. 3 includes an optional phase in which the electrode pixel configuration is converted into a fixed, connected polygon-based electrode design for deposition onto a substrate of a microchannel of a low cost PoC application.

Figure 4:
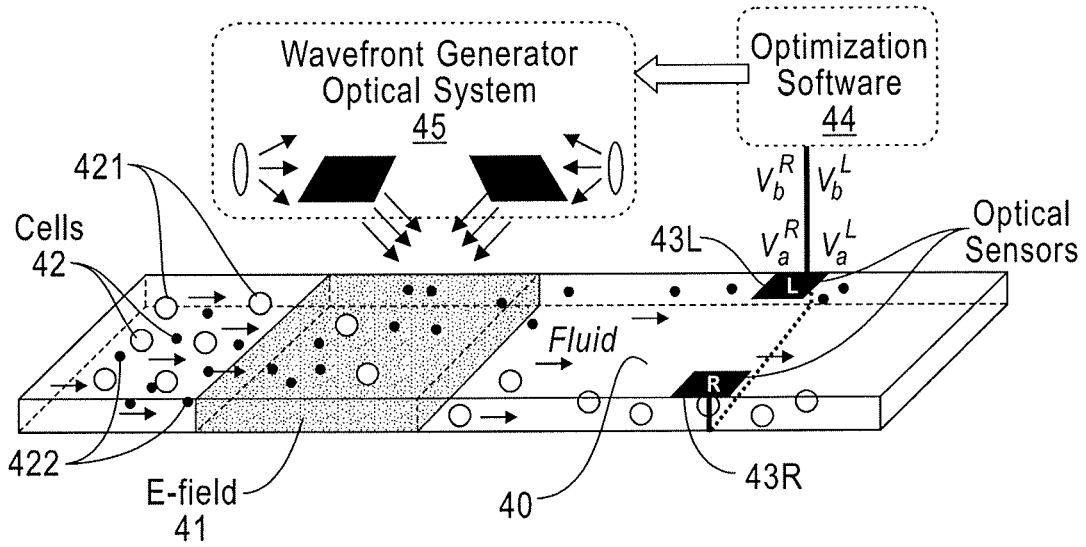
FIG. 4 depicts a system including a microchannel with a flowing fluid where particles are suspended and two optical sensors connected to a wavefront generator which creates arbitrary wave patterns inside the microchannel, according to an embodiment of the disclosure.

FIG. 4 depicts an embodiment that includes a wavefront generator optical system 45 that can create arbitrary electromagnetic wave patterns focused inside a microchannel 40, which in turn generate an E-field distribution 41. The E-field is capable of guiding cells 42 of types "a" 421 and "b" 422, suspended in a fluid that is flowing along the length of the channel and are initially distributed across the entire width of the channel, towards one side or the other of the channel depending on cell properties, such as size and material, after passing through the illuminated area. Fluorescent sensors 43R, 43L are located at or beyond the exit of the illuminated area, with at least one on each side of the channel (L/R), to detect cells as they flow past that location. The value of an objective function $f(u)=f(M,\{p\},\vec{x}_l)=(V_a^R-V_b^R)+(V_b^L-V_a^L)$ according to an embodiment is optimized to maximize the volume $V_a^R$ of cells of type "a" passing along the right side of the channel and the volume $V_b^L$ of cells of type "b" passing along the left side, and minimize the volume $V_a^L$ of particles a passing along the left side and the volume $V_b^R$ of particles b passing along the right side. The value of the objective function is optimized by optimization software 44. Based on measurement signals received from sensors 43R and 43L, the optimization software 44 instructs the wavefront generator optical system 45 to readjust the electromagnetic wave patterns focused inside a microchannel 40 to optimize the value of the objective function.

An exemplary embodiment as illustrated in FIG. 4 includes an initialization and optimization phase as illustrated in FIG. 3. An E-field pattern within the channel can be described as the interference of several wavefronts illuminating the channel at various incident angles with predefined amplitude and phase. An arbitrary wavefront can be generated using a laser beam propagating through a reconfigurable 2D diffractive optical element (DOE). The reconfigurable DOE includes an array of movable micro-mirrors, and can be remotely controlled based on the result of the optimization procedure, to generate several wavefronts. The wavefronts are focused into the channel 40 by additional optical components.

The value of an objective function, according to an embodiment, can be optimized using conventional methods to produce a new set of incident wave parameters, such as angle, amplitude, phase, and polarization, that illuminate the microchannel 40 in each iteration, and the effectiveness is quantified by the value of the objective function. The parameters for an optimum design can be stored in a library for later use.

Figure 5:
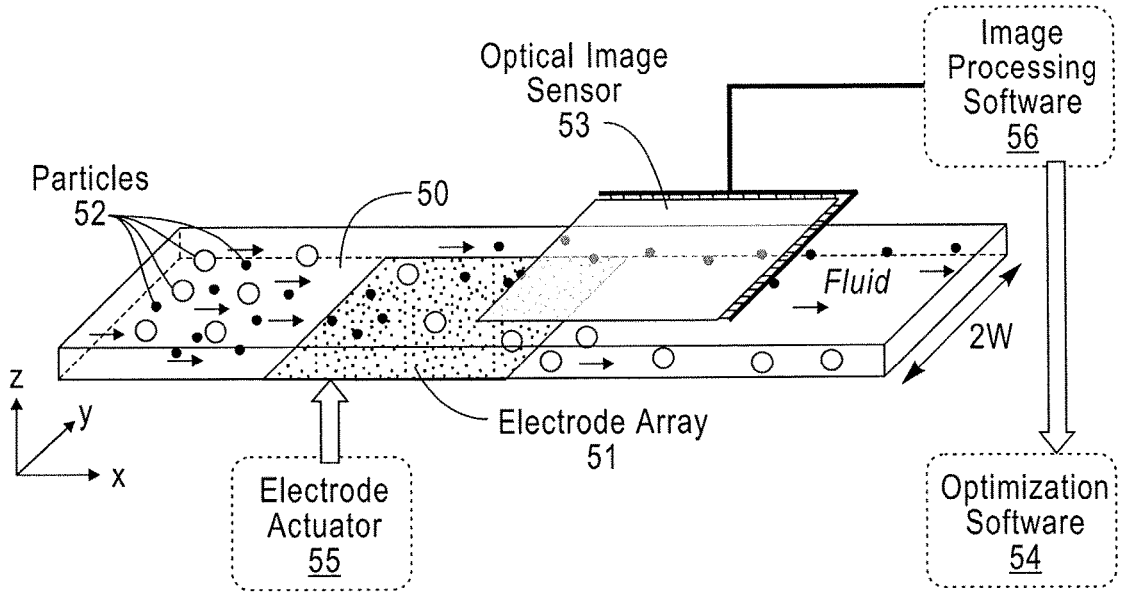
FIG. 5 depicts a particle manipulation device comprising an array of electrodes embedded in a microchannel and an image sensor on or near one of the microchannel surfaces, according to an embodiment of the disclosure.

FIG. 5 depicts another embodiment of a particle manipulation device in which an array of electrodes 51 with individually addressable elements is embedded in a microchannel 50 and used to guide particles 52, suspended in a fluid flowing along the length of the channel and initially distributed across the entire width 2W of the channel 50, towards one side or the other of the channel 50, depending on particle properties, such as size and material. According to an embodiment, a high resolution 2D image sensor 53 is positioned on top of or downstream with respect to the electrode array 51 to capture the entire area of the channel with flowing particles. Image processing software 56 applied to the image sensor output can be used to extract particle position and size information as a function of time. According to an embodiment, the objective function quantifies the distance between each particle type and the corresponding channel side. For example, the value of the objective function $$f(u)=f(M,\{p\},\vec{x}_l)=\frac{1}{K}\sum_{i=1}^{K}(W-y_a^i|_{x=exit})^2+\frac{1}{N}\sum_{j=1}^{N}(-W-y_b^j|_{x=exit})^2$$

is optimized to minimize the distance between the position $y_a^i$ of particle i of type "a" to microchannel side located at "+W" and minimize the distance between the position $y_b^j$ of particle j of type "b" to position "−W". The number of particles of type "a" is K, and the number of particles of type "b" is N. The state of the system is optimized by optimization software 54 via the manipulation of the electrode array 51 through the electrode actuator 55 based on position data received from the image processing software 56.

An exemplary embodiment as illustrated in FIG. 5 includes an initialization and optimization phase as illustrated in FIG. 3, and can also store optimal operating parameters in a library. The relevant information $(\{p\},\vec{x}_l)$ includes parameters defined during the initialization and optimization phases, such as particle size, flow rate, temperature, etc., {p}, as well as sensor output from operation or training, such as particle positions $\vec{x}_l$. Each particle-fluid state can therefore be described by a set of operational parameters {p}. Using standard machine learning approaches, a system according to an embodiment of the disclosure can be trained to classify the various sets of operational parameters {p}, which enables a judgment of the similarity of the operational parameters for different uses. According to an embodiment, a non-limiting similarity between the sets of operational parameters for two different systems can be a Euclidean distance, although other metrics are possible. Using this criteria, two sets can be classified differently if the Euclidean distance between them is greater than a predetermined value. With this classification, for a previously untested system, a user can use as input to the optimization step an already optimized state of the electric field M, represented in an embodiment by the electrode voltage pattern, from a similar system. Alternatively, a user can skip the optimization step altogether and use the state of the electrode pattern, optimized for a similar system.

In another phase of the exemplary embodiment illustrated in FIG. 5, the machine learning results are used to identify setup characteristics, and based on this identification choose a good starting configuration for the electrode pattern that may still be subject to an iterative optimization routine if desired.

Figure 6:
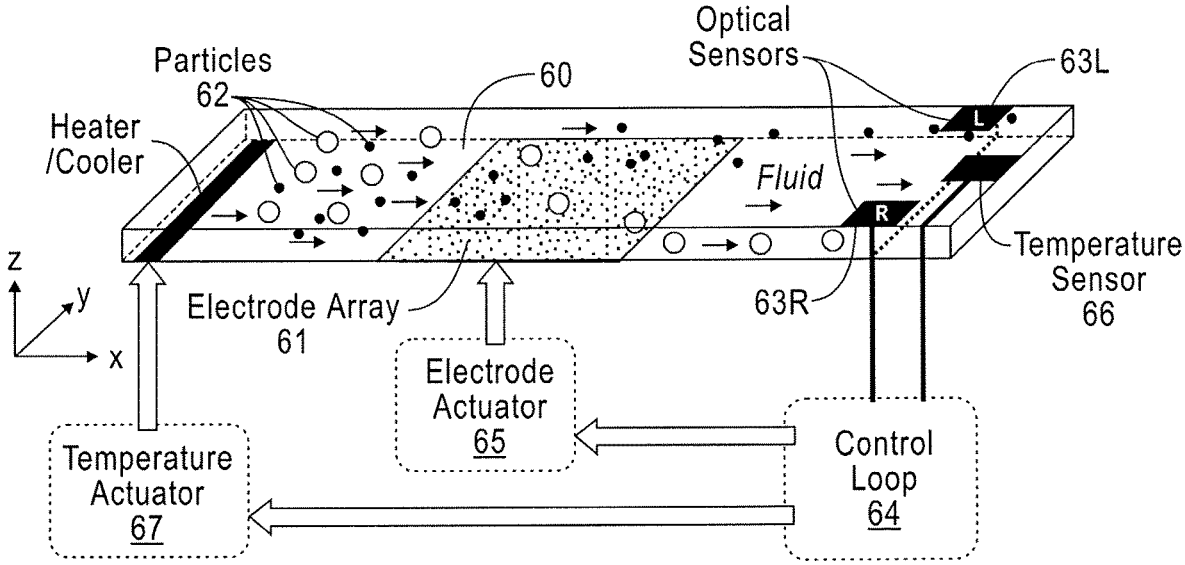
FIG. 6 displays another particle manipulation device comprising an array of electrodes embedded in a microchannel and a control loop implementation comprising one or more sensors and actuators, according to an embodiment of the disclosure.

FIG. 6 depicts another embodiment of the disclosure, in which an array of electrodes 61 with individually addressable elements is embedded in a microchannel 60 used to guide particles 62, suspended in a fluid flowing along the length of the channel and initially homogeneously distributed across the entire width of a channel 60. The particles can be concentrated/screened towards one side or the other of the channel 60, depending on particle properties, such as size and material. Fluorescent/Optical/Electrical sensors 63L, 63R can be located at or beyond the exit of the array, with at least one on each side of the channel (L/R) that are used to detect the particles as they flow past that location. Additional sensors can be integrated in the device to measure other parameters such as temperature 66, flow speed, device orientation, etc. Actuators, such as a local heater 67, a light emitter, mechanical mixers, etc., may also be used to change the state of the system. According to an embodiment, a control loop 64 collects measurements from the various sensors and provides real-time adjustments to an electrode actuator 65 or other actuators 67 to drive the state of the system toward a desired reference state.

An exemplary embodiment, as illustrated in FIG. 6, includes an initialization and optimization phase as illustrated in FIG. 3. According to an embodiment, another phase involves the experimental determination of device dynamics, i.e., control theory methods can be used to run various experiments to measure the system's response to various inputs. The controls or actuators can be based upon results of the initialization and optimization phase or upon expectations for system response. The identification of a desired reference state, in terms of system sensors, may or may not be based upon results from the initialization and optimization phase.

Figure 7:
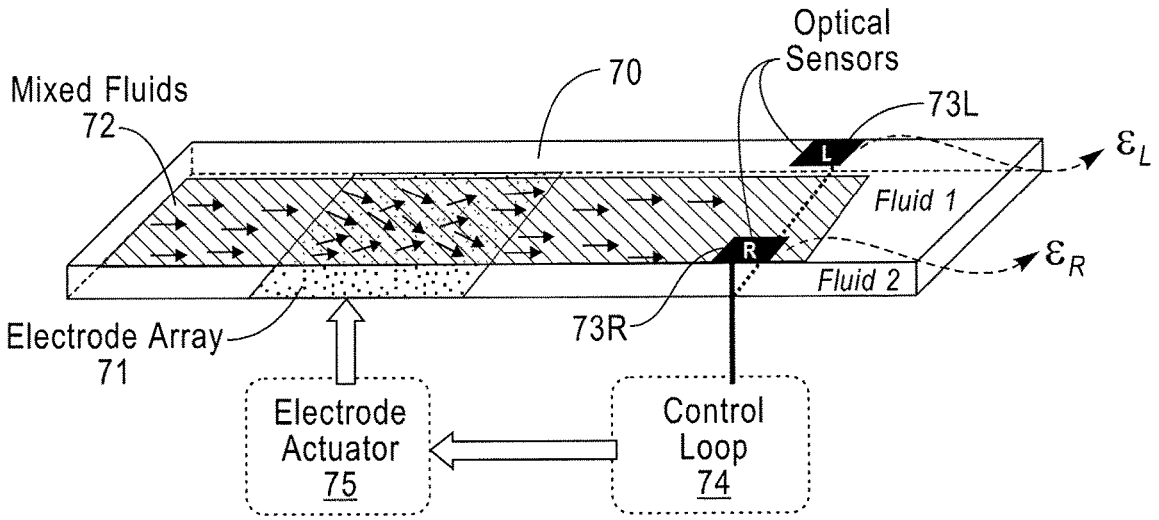
FIG. 7 displays a fluid manipulation device used to separate a mixed fluid emulsion, according to an embodiment of the disclosure.

FIG. 7 depicts another embodiment of the disclosure, in which an array of electrodes 71 with individually addressable elements is embedded in a microchannel 70 and used to separate a mixed fluid emulsion 72 having a "D" dispersed phase (Fluid 1) from a "C" continuous phase (Fluid 2) by applying DEP forces in opposite directions to the different phases. Solid dielectric beads with size comparable to that of the droplets and with high D-philicity may also be used. Optical, chemical or electrical sensors 73R, 73L can be located at or beyond the exit of the array, with at least one on each side of the channel (L/R), that are used to detect the droplets as they flow past that location. A Y-junction at the end of the channel can be used to collect the D-rich portion and coalesce the droplets. Additional sensors can be integrated into the device to measure other parameters, such as temperature, flow speed, pH, conductance, etc. Actuators, such as a local heater, a light emitter, etc., may also be used to facilitate the emulsion separation. According to an embodiment, a control loop 74 is used to collect measurements from the various sensors and provide the instructions to an electrode actuator 75 to adjust the electrode configuration 71 or other actuators, in real time, to drive the state of the system toward a desired reference state.

An exemplary embodiment as illustrated in FIG. 7 includes an initialization and optimization phase as illustrated in FIG. 3. According to an embodiment, the on/off 2D voltage pattern of the electrodes is optimized to apply the required forces on the distinct emulsion phases. In case D-philic solid beads are present, the forces should lead to a smooth lateral movement to better guide the D-rich droplets. In addition, to quantify the extent to which the system is optimized, an objective function $f(u)=f(M,\{p\},\vec{x}_l)=\varepsilon_R-\varepsilon_L$ can be defined, in which $\varepsilon_R$ and $\varepsilon_L$ represent an optical property, such as a dielectric constant determined from the reflected light, of fluid passing through the right sensor and left sensor, respectively.

Figure 8:
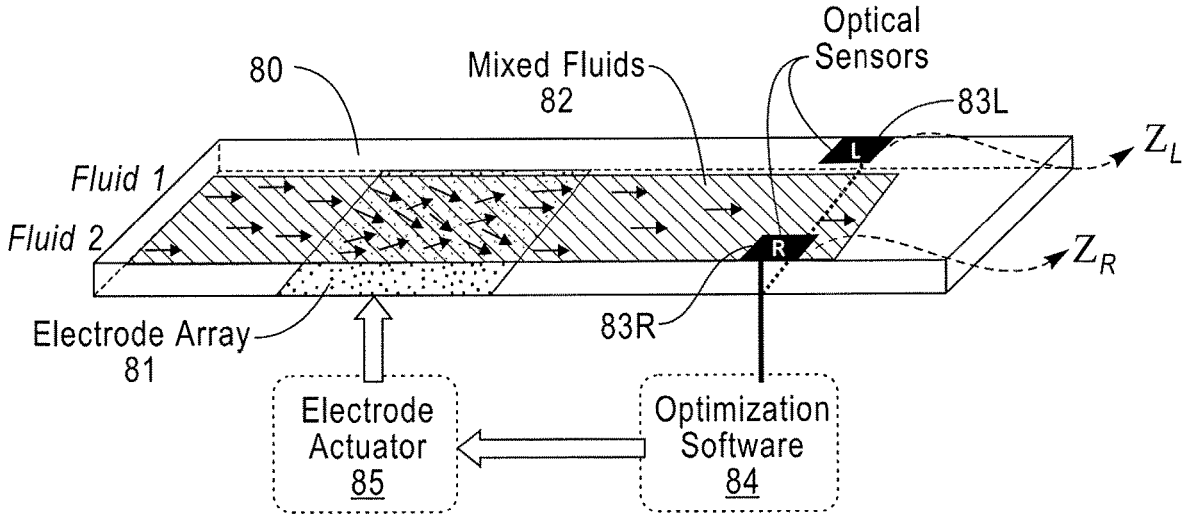
FIG. 8 displays a fluid manipulation device used to create emulsions or mixes, according to an embodiment of the disclosure.

FIG. 8 depicts another embodiment of the disclosure, in which an array of electrodes 81 with individually addressable elements is embedded in a microchannel 80 and used to create a periodic movement of solid dielectric beads 82 flowing with 2 miscible fluids inside the microchannel 80 to mix the two miscible fluids or create emulsions out of binary mixtures, to control the reaction rates in chemical or biological processes. Mixing would otherwise rely solely on diffusion, requiring longer channel sections and more time. Electrical, optical or chemical sensors 83L, 83R can be located at or beyond the exit of the array to detect the mixture/emulsion as it flows past that location. For example, electrical sensors can be used to deduce electrical properties, such as capacitance or impedance, of the fluid passing through that location. To quantify the extent to which a system is optimized, according to an embodiment, an objective function can be defined as $f(u)=f(M,\{p\}\vec{x}_l)=Z_R-Z_L$ which quantifies the differences in the electrical property measured at opposite sides of the channel, which is considered an indication of a homogenous mix. The value of the objective function is optimized by optimization software 84 by providing the electrode actuator 85 with the readjustments to the voltages of the electrode array 81 based on measurement signals received from sensors 83R and 83L. According to embodiments, $Z_R$ and $Z_L$ represent an electrical property, such as an impedance measured across a channel height, of fluid passing through the right sensor and left sensor, respectively. Other embodiments can use other objective functions. According to embodiments, additional sensors can be used to measure other parameters, such as temperature, flow speed, pH, conductance, etc. Actuators, such as a local heater, a light emitter, etc., may also be used to tailor the mixture and, hence, the reaction rates.

An exemplary embodiment as illustrated in FIG. 8 includes an initialization and optimization phase as illustrated in FIG. 3. The on/off 2D voltage pattern of the electrodes can be provided with an AC voltage signal that induces a periodic movement of the solid beads with given amplitude and frequency. The AC 2D pattern can be optimized to maximize the mixing of the two species.

In a further phase of an embodiment as illustrated in FIG. 8, actuators, such as a heater, can be used to not only increase the solubility of one phase into the other, but also to accelerate reaction rates by providing thermal energy to endothermic processes. Similarly, a light emitter can be used to accelerate reaction rates of photo-activated chemical processes.

As will be appreciated by one skilled in the art, embodiments of the present disclosure may be embodied as a system, method or computer program product. Accordingly, embodiments of the present disclosure may take the form of an entirely hardware embodiment, an entirely software embodiment (including firmware, resident software, microcode, etc.) or an embodiment combining software and hardware embodiments that may all generally be referred to herein as a "circuit," "module" or "system." Furthermore, embodiments of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for embodiments of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Embodiments of the present disclosure are described below with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Figure 9:
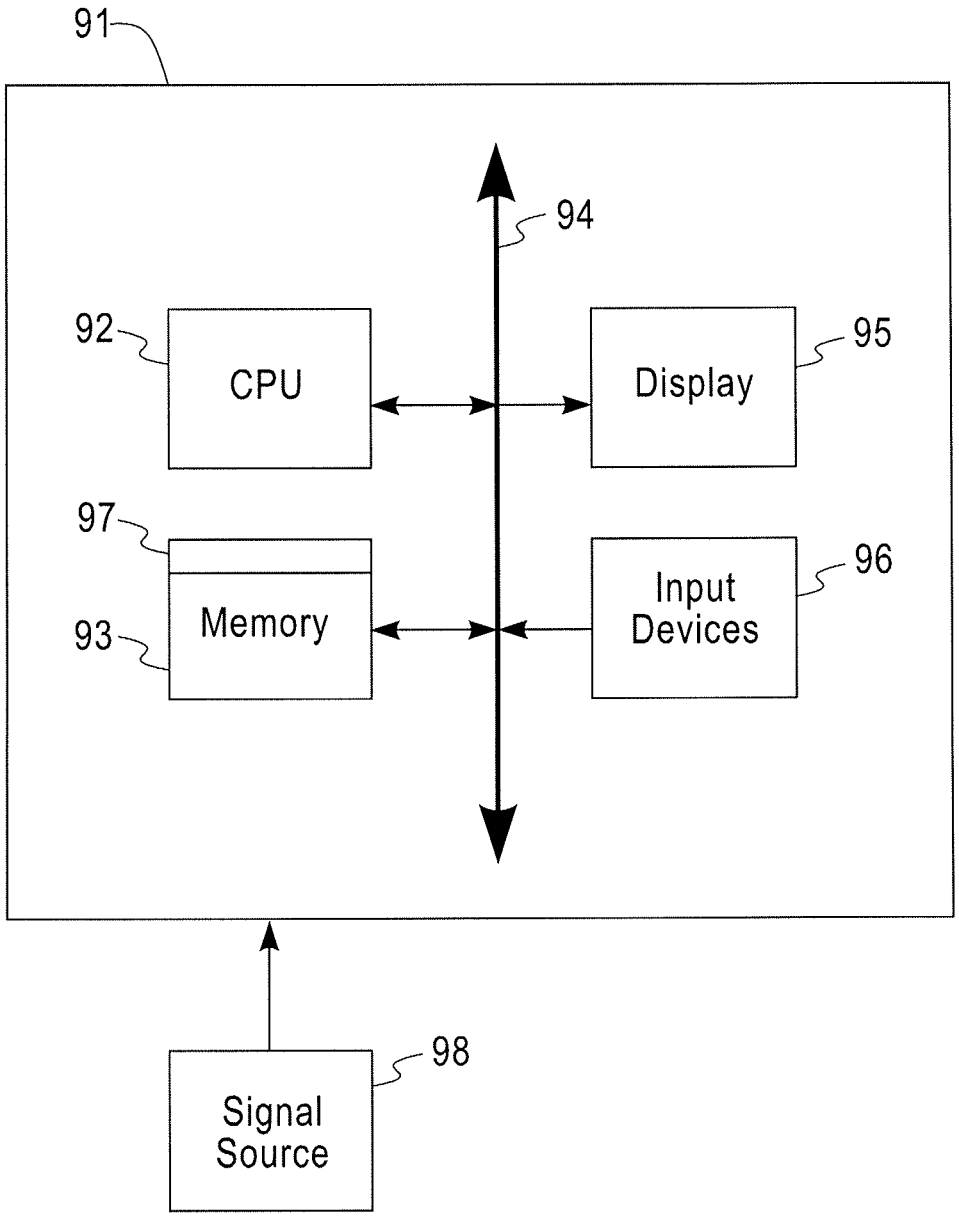
FIG. 9 is a block diagram of a hardware architecture for a computational unit that implements real time optimization and control, according to an embodiment of the disclosure.

FIG. 9 is a block diagram of an exemplary computer system for implementing a method for measuring the effectiveness of content being presented on a display to produce an interaction by a viewer according to an embodiment of the disclosure. Referring now to FIG. 9, a computer system 91 for implementing the present disclosure can comprise, inter alia, a central processing unit (CPU) 92, a memory 93 and an input/output (I/O) interface 94. The computer system 91 is generally coupled through the I/O interface 94 to a display 95 and various input devices 96 such as a mouse and a keyboard. The support circuits can include circuits such as cache, power supplies, clock circuits, and a communication bus. The memory 93 can include random access memory (RAM), read only memory (ROM), disk drive, tape drive, etc., or a combinations thereof. The present disclosure can be implemented as a routine 97 that is stored in memory 93 and executed by the CPU 92 to process the signal from the signal source 98. As such, the computer system 91 is a general purpose computer system that becomes a specific purpose computer system when executing the routine 97 of the present disclosure.

The computer system 91 also includes an operating system and micro instruction code. The various processes and functions described herein can either be part of the micro instruction code or part of the application program (or combination thereof) which is executed via the operating system. In addition, various other peripheral devices can be connected to the computer platform such as an additional data storage device and a printing device.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the present disclosure has been described in detail with reference to exemplary embodiments, those skilled in the art will appreciate that various modifications and substitutions can be made thereto without departing from the spirit and scope of the disclosure as set forth in the appended claims.

What is claimed is:

1. A system for manipulating electric fields within a microscopic fluid channel, comprising:

a microfluidic channel with at least one inlet and at least one outlet to support fluid flow;

a wavefront generator optical system that includes an electromagnetic field source that generates a laser beam and a reconfigurable 2-dimensional diffractive optical element that includes a reconfigurable array of movable micro-mirrors and that applies a non-uniform and adjustable electric field from the laser beam to one or more regions of the microfluidic channel, wherein the wavefront generator optical system is positioned between at least one inlet and the at least one outlet;

one or more sensors positioned downstream in the microfluidic channel from the wavefront generator optical system that measure one or more parameters of a fluid flowing through the microfluidic channel, wherein the sensors are positioned between the wavefront generator optical system and the at least one outlet; and a controller that is individually connected to each micromirror of the reconfigurable array of movable micromirrors and that includes software that receives signals from the one or more sensors representative of values of the one or more parameters, wherein, based on the parameter values, the controller software individually and independently drives each of the movable micromirrors to adjust the electric field produced by the electromagnetic field source to generate several wavefronts that are focused into the fluid channel by additional optical components to produce and modify the electromagnetic field distribution inside the channel in real time, wherein a complex fluid comprising at least two components flows through the microfluidic channel, wherein the controller adjusts the electric field in real time to control flow of the complex fluid through the microfluidic channel according to a pre-determined criteria.

2. The system of claim 1, further comprising one or more actuators controllable by the controller to affect physical properties of the complex fluid, wherein the one or more actuators comprise at least one of a heater, or a mechanical mixer.

3. The system of claim 1, wherein a hardware component of the controller controls the one or more actuators based on output of a feedback control loop of a software component to adjust the electric field to maintain the flow of the complex fluid through the fluid channel in a reference state.

4. The system of claim 1, wherein the parameters include one or more of a chemical composition, a chemical reaction rate, a surface functionalization, an impedance at a single frequency, an impedance within a frequency range, a temperature, a viscosity, a flow speed, or an image pattern.

5. The system of claim 1, wherein the diffractive optical element is externally located with respect to the microfluidic channel and generates and focuses the laser beam inside the channel and modulates a resulting electric field distribution inside the fluid through interference of several waves propagating at different directions and with different amplitudes and phases.

6. The system of claim 1, wherein the at least two components comprises a plurality of first particles and a plurality of second particles suspended in the fluid, wherein the controller software controls the configuration of the reconfigurable array of movable micro-mirrors to maximize a volume of first particles passing along a right side of the channel and a volume of second particles passing along a left side of the channel, and minimize a volume of first particles a passing along the left side of the channel and a volume of second particles passing along the right side of the channel.

7. A system for manipulating electric fields within a microscopic fluid channel, comprising:

a fluid channel with at least one inlet and at least one outlet to support fluid flow;

a 2-dimensional (2D) array of individually controllable electrodes embedded in a wall of the fluid channel that apply a non-uniform and adjustable electric field to one or more regions of the fluid channel, wherein the 2D array of individually controllable electrodes is positioned between at least one inlet and the at least one outlet;

an electric field actuator that is independently connected to each of the individually addressable electrodes;

one or more sensors positioned downstream in the microfluidic channel from the 2D array of individually controllable electrodes and that measure one or more parameters of a fluid flowing through the fluid channel, wherein the sensors are positioned between the 2D array of individually controllable electrodes and the at least one outlet; and a controller that is connected to the electric field actuator and that includes software that receives signals from the one or more sensors representative of values of the one or more parameters and, based on the parameter values, provides instructions to the electric field actuator wherein the electric field actuator separately adjusts each electrode of the array of individually controllable electrodes to adjust the electric field across an entire width of the channel in real time, wherein a complex fluid comprising at, least two components flows through the fluid channel, and the electric field is adjusted in real time to dynamically manipulate the flow of the complex fluid through the fluid channel according to a pre-determined criteria.

8. The system of claim 7, further comprising one or more additional actuators controllable by the controller to affect physical properties of the complex fluid, wherein the one or more additional actuators include one or more of a heater or a mechanical mixer.

9. The system of claim 8, wherein a software component of the controller uses a feedback control loop to control the electric field actuator to adjust the electric field to maintain the flow of the complex fluid through the fluid channel in a reference state, based on values of the one or more parameters measured by the one or more sensors.

10. The system of claim 7, wherein the parameters include one or more of a chemical composition, a chemical reaction rate, a surface functionalization, an impedance at a single frequency, an impedance within a frequency range, a temperature, a viscosity, a flow speed, or an image pattern.

11. The system of claim 7, wherein one of the at least two components includes particles suspended in the fluid, wherein the electric field actuator changes a voltage configuration of the 2D array of individually controllable electrodes to maximize a difference between a volume of particles a passing along a right side of the fluid channel and a volume of particles a passing along a left side of the fluid channel.

12. The system of claim 7, wherein the at least two components comprise a plurality of first particles and a plurality of second particles suspended in the fluid, wherein the electric field actuator changes a voltage configuration of the 2D array of individually controllable electrodes to minimize a distance between a position of a first particle to a right side of the fluid channel and minimize a distance between a position of a second particle to a left side of the fluid channel.

13. The system of claim 7, wherein the at least two components form a mixed fluid emulsion that includes a first fluid phase dispersed in a second, continuous fluid phase, wherein the electric field actuator changes a voltage configuration of the 2D array of individually controllable electrodes to separate the first fluid phase from the second, continuous fluid phase.

14. The system of claim 7, wherein the at least two components include solid dielectric beads flowing with two miscible fluids, wherein the electric field actuator changes a voltage configuration of the 2D array of individually controllable electrodes to create a periodic movement of solid dielectric beads to mix the two miscible fluids.

* * * * *